United States Patent [19]

Woolsey

[11] Patent Number: 4,823,702

[45] Date of Patent: Apr. 25, 1989

[54] SHOTGUN PROJECTILE

[76] Inventor: Robert Woolsey, 16 Chicory Way, Irvine, Calif. 92715

[21] Appl. No.: 63,964

[22] Filed: Jun. 19, 1987

[51] Int. Cl.[4] ..... F42B 13/21

[52] U.S. Cl. ..... 102/502; 102/460; 102/507

[58] Field of Search ..... 102/395, 482, 483, 484, 102/485, 460, 498, 501, 502, 507, 508, 509, 510, 517, 518, 519, 529

[56] References Cited

U.S. PATENT DOCUMENTS

| | | | |
|---|---|---|---|
| 1,112,413 | 9/1914 | Hoagland . | |
| 1,575,716 | 3/1926 | Parek . | |
| 1,583,559 | 5/1926 | Kenneweg . | |
| 1,883,575 | 10/1932 | Clyne . | |
| 3,074,344 | 1/1963 | Devaux . | |
| 3,733,727 | 5/1973 | Jones et al. | 102/502 |
| 3,865,038 | 2/1975 | Barr . | |
| 3,911,824 | 10/1975 | Barr et al. . | |
| 3,952,662 | 4/1976 | Greenless . | |
| 3,972,286 | 8/1976 | Canon . | |
| 3,996,865 | 12/1976 | Dwyer . | |

*Primary Examiner*—Deborah L. Kyle
*Assistant Examiner*—Richard Klein
*Attorney, Agent, or Firm*—George F. Bethel; Patience K. Bethel

[57] ABSTRACT

A projectile for shooting from the muzzle of a shotgun formed with a nose cone connected to a launching tube by an interconnecting body. The nose cone has a weighted portion for providing aerodynamic characteristics thereto and a frangible portion. Upon impact against a target, the frangible portion breaks allowing the nose cone walls to deform in a mushroom-like manner, spreading the load over a larger area, thereby diminishing the amount of damage to a target to that of a nose cone which did not spread and mushroom from the breaking of frangible material therein.

17 Claims, 2 Drawing Sheets

SHOTGUN PROJECTILE

BACKGROUND OF THE INVENTION

The background of this invention lies within the non-destructive, non-lethal projectile art. It lies within the art of providing a non-lethal projectile from a shotgun or other projectile means to stop or immobilize a target such as an animal or human being. In particular, it lies within the art of slowing down, immobilizing or stopping a person in a violent act, or one who is about to perpetrate a violent act, such as a criminal. It is a projectile used by police officers specifically to knock down or immobilize such a prospective or criminal person to prevent them from committing or further committing a crime while at the same time substantially trying to prevent material and lethal damage to the individual target.

THE PRIOR ART

The prior art with regard to non-lethal projectiles varies over a wide margin. It encompasses certain features with regard to various materials that are used for non-lethal disablement of a target. In the prior art there is not shown a generally friable type of material within a nose cone that is projected from a shotgun. The prior art generally only shows various configurations which do not encompass the characteristics of a friable body with proper loading and balance in order to create an accurate and effective non-lethal projectile. To the contrary, the prior art merely presents various large, supposedly non-lethal and non-damaging projectiles.

Such non-lethal and non-damaging projectiles are fired in a manner whereby they do not effectively provide for accuracy between the initial firing and the target. Furthermore, they have often been proven to be either too inocuous in their impact, or too damaging.

This invention overcomes the deficiencies of the prior art by providing a non-lethal projectile that impacts and spreads a load in a significant manner across a target's thorax or body area at which it impacts. The spread is enhanced by the friable material within the nose cone of the projectile. The projectile is streamlined and balanced in order to provide significant accuracy.

The streamlining and balancing are provided by a nose cone that is weighted with shot in the nose cone area. At the same time it provides for a friable material within and behind the shot that upon impact will spread the load on a target's body. This being the case, the impact and the load is spread in a greater manner than if the nose cone remained in a solid state. The retention of the nose cone shape during flight while at the same time providing a spread after impact enhances the accuracy, as well as the non-lethal characteristics of the projectile. The impact loading is spread across a target's body so as to lessen the overall force to the impact area.

The features of this invention as described and the advantages over the prior art will become apparent hereinafter based upon the following summary of this invention and in particular, the specification which follows.

SUMMARY OF THE INVENTION

This invention comprises a non-lethal projectile having a streamlined nose cone with a launcher tube attached thereto and wherein the nose cone incorporates a weighted mass to provide accuracy of projection and a friable mass within and behind the weighted mass to spread the load upon impact.

The invention incorporates a launcher tube with a nose cone attached thereto. The launcher tube and the nose cone are interconnected with a body which connects the nose cone to the launcher tube. The body is adhered to the nose cone and the launcher tube.

Within the nose cone is a first weighted mass. The weighted mass is toward the streamlined front end of the nose cone. Within and behind the weighted mass is a friable portion which breaks upon impact. The friable portion upon impact allows the nose cone to spread over a larger area, thereby reducing the force over a given area.

The foregoing allows for a projectile to be fired against a target. After firing, the projectile travels accurately toward a target and impacts the target with accuracy in the respective area at which the projectile is fired.

Upon impact the friable portion breaks and causes the nose cone to spread over a given area thereby spreading the load over a greater area than the impact of the nose cone would normally impart. This reduces the damage and helps to immobilize the target without in many cases serious or lethal damage.

The projectile can be launched from a standard police issue shotgun by means of a blank cartridge with a charge of powder. The powder should be sufficient to adequately propel the projectile at 250 feet per second so as to enable the projectile to impact the target at approximately 230 foot pounds of impact force.

BRIEF DESCRIPTION OF THE DRAWINGS

The invention will be more clearly understood by reference to the description below taken in conjunction with the accompanying drawings wherein.

DESCRIPTION WITH THE PREFERRED EMBODIMENTS

Figure 1:
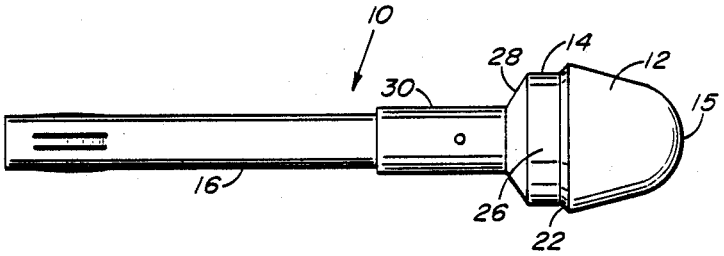
FIG. 1 shows a side elevation view of the non-lethal projectile of this invention.
Figure 3:
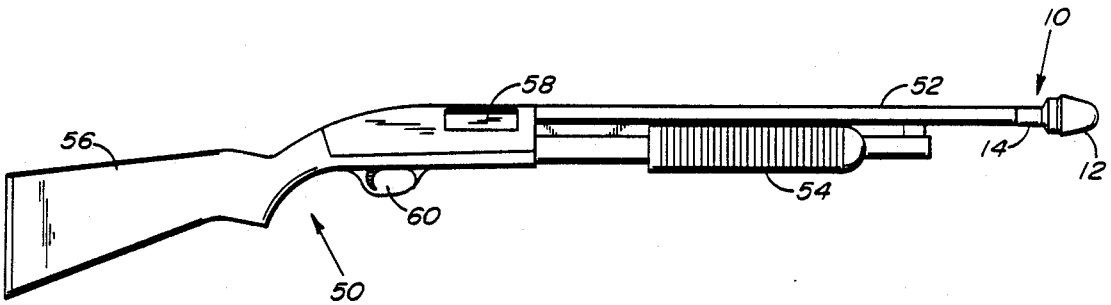
FIG. 3 shows a shotgun with the non-lethal projectile inserted within the muzzle of the shotgun.

Looking at FIG. 1, it can be seen that the non-lethal projectile 10 of this invention has been shown in its entirety in a side elevation view. The non-lethal projectile generally comprises four major components, as will be seen in the next paragraph.

The non-lethal projectile 10 is shown having a nose cone 12, a body portion 14, and a launcher tube 16. The three respective portions of the nose cone, body and launcher tube retain a matrix within the nose cone which is seen in the cross sectional view of FIG. 2.

The matrix is shown as material 16 which shall be referred to hereinafter in greater detail with regard to the component parts thereof.

The nose cone 12 is formed of a thermoplastic material such as polyethylene. It can be also formed of polypropylene or polyvinyl chloride (PVC). The main criteria is that the nose cone 12 be formed in a manner which can allow the nose cone to collapse upon impact and yet at the same time maintain sufficient resiliency during flight.

Figure 2:
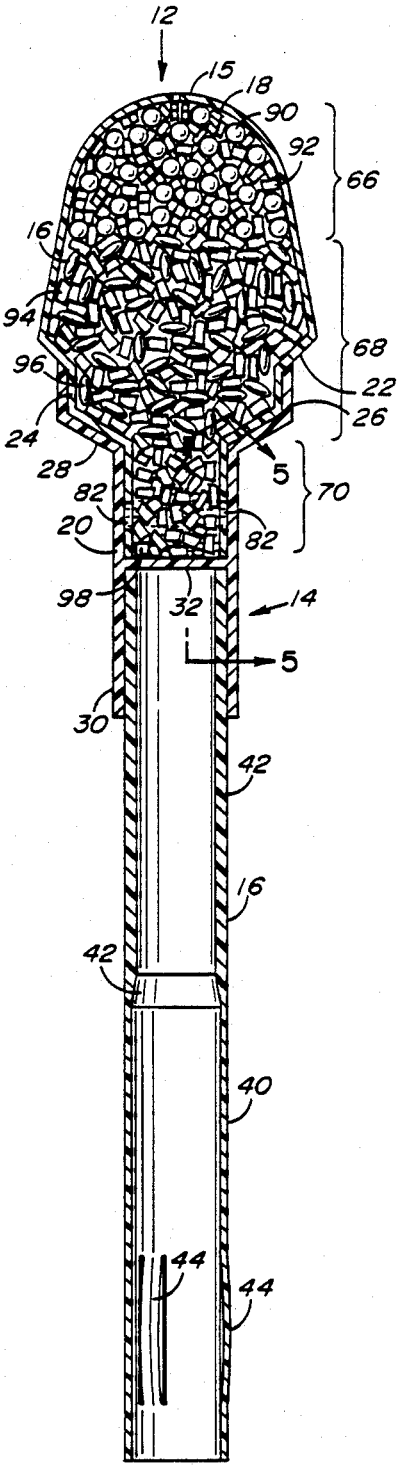
FIG. 2 shows a midline sectional view of the non-lethal projectile of this invention.

The nose cone 12 should have sufficient resiliency or rigidity to retain the shape of the nose cone during travel to the target. Upon impact, the plastic walls of the nose cone should be sufficiently soft to allow deformation thereof. In particular, the wall 18 of the nose cone as seen in FIG. 2 should have the ability to deform under impact. When formed of thermoplastic material or any material that will mushroom in the manner set forth hereinafter, it will be sufficient. This could include various plastic elastomers, and stretchable plastic and elastomeric resilient materials.

The body 14 is formed from acrylonitrile butadiene styrene (ABS) body material. This allows the wall 20 of the body (14) to resiliently hold the nose cone 12 in place as it is seated in the body.

The nose cone 12 extends inwardly at a reduced portion or shoulder 22. The shoulder 22 has a relatively axial wall portion 24 which extends into an axial wall portion 26 of the body 14. The axial wall portion 26 of the body 14 extends and flares inwardly in an inwardly projecting sloping wall portion 28. This inwardly sloping wall portion 28 terminates in an extended tubular portion 30. The extended tubular portion 30 is spanned by an interior wall or web 32.

The foregoing configuration generally comprises the nose cone 12 and body 14 configuration.

It should be noted that the nose cone 12 has a rounded streamlined portion or nose 15. The nose 15 is formed in a manner whereby it is streamlined in order to provide for aerodynamic movement through the air as the projectile is shot toward a target. The rounded nose 15 of the nose cone 12 can be designed to be rounded, more or less pointed, or of an ogive configuration, depending upon the specific impact requirements, plastic, flexible, stiff or resilient nature of the nose cone, deformation characteristics and other aspects as dictated by the requirements of the projectile upon impact.

The body 14 is joined to the launcher tube 16 within the interior walls of the tubular portion 30 of the body. The launcher tube wall has a reduced thickness 40 and an enlarged thickness 42. This is shown by the expansion shoulder 42 extending back into the thinner wall portion 40.

The thinner wall portion 40 of the launcher tube 16 includes a plurality of expanded slits, protuberances, tabs or elongated enlargements 44. The expanded slits or protuberances 44 allow the launcher tube 16 to remain in the muzzle of a shotgun and not fall out when the shotgun is turned in various directions. The expanded slits 44 should be relatively resilient yet at the same time sufficiently flexible to allow sliding of the launcher tube 16 into the muzzle of the shotgun, and out upon firing.

From the foregoing structure of the nose cone 12, body 14 and launcher tube 16, it can be seen that the three respective parts are of a particularly resilient or stiff nature in two cases and of a flexible nature in the first case. In particular, the nose cone 12 is relatively deformable and deforms against the shoulder 26 of the body 14 upon impact. The body 14 and launcher tube 16 are resilient and relatively inflexible. This allows them to function in the manner as will be described hereinafter after the projectile has been fired from the shotgun.

Turning more particularly to the shotgun 50 it is shown having a barrel 52 and a pump handle 54 for loading the chamber of the shotgun. A stock 56 is shown with a loading chamber 58 and trigger portion 60.

The projectile 10 has been inserted in the muzzle portion of the barrel 52. The projectile 10 can be seen with the body 14 extending therefrom terminating in the nose cone 12. The projectile 10 is held within the shotgun in a frictional engagement by virtue of the expanded tabs 44 extending against the interior dimensions of the shotgun barrel 52.

A key element of this invention is the composition of the material within the nose cone 12. The composition of the material is divided into three respective zones. The first zone is the leading or weighted zone of the nose cone 12. This zone has been numbered zone 66 and comprises a fifty-fifty blend of 177 mm steel shot and ABS pellets. The ABS is a multi-polymer thermoplastic consisting of acrylonitrile butadiene and styrene (ABS). The shot and ABS pellets are blended and poured into the nose cone when the cone is in an inverted position. The nose cone, as previously stated, is molded from low density semi-flexible polyethylene.

The matrix of the fifty-fifty blend of the steel shot and ABS pellets are then sprayed with a solvent. The solvent can either be methylene chloride or MEK. This bonds the ABS pellets together and locks the steel balls within the friable matrix. It is important to note that this matrix is sufficiently friable, frangible or capable of being broken upon impact. This allows the materials to take the shape of the deformed or mushroomed out nose cone 12 upon impact.

A second zone of the nose cone zone 68 comprises a fifty-fifty blend of ABS pellets and high density polyethylene pellets (HDPE). The blend of the ABS and HDPE pellets are poured on top of the weighted matrix zone 66. This second zone is again sprayed with a solvent. The ABS pellets bond together, locking the HDPE pellets within their framework. The HDPE is not attacked by the solvent thereby contributing to the of friability or frangibility of the second zone 68.

The combination of the first zone 66 and second zone 68 provide two friable or frangible portions within the nose cone 12. These two respective friable portions allow for a breakdown of their respective elements so that they will break on impact and deform in concert with each other in a mushrooming manner within the nose cone 12.

A third zone 70 comprises 100% ABS pellets. These pellets are sprayed with a solvent to form a rigid structure. The reason for the rigid structure in the third zone 70 is to accommodate the nose cone 12 and the body 14 so that they are relatively rigidified in the joindure between the launching tube 16 and the body in conjunction with the nose cone 12. This provides a relatively rigid assembly that can be launched from the muzzle of the shotgun barrel 52.

Figure 5:
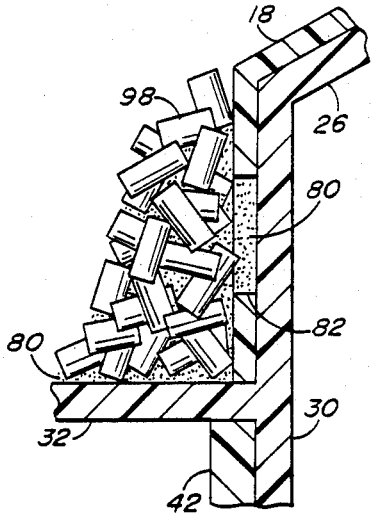
FIG. 5 shows a detailed sectional view as encircled and taken from FIG. 2 through a circular area labeled 5.

In order to secure the assembly of the nose cone 12 to the body 14, it can be seen in FIG. 5 that there are holes drilled through the side walls 18 of the nose cone. The nose cone wall 18 as it is seated within the wall 26 of the body 14 is in relatively tightened juxtaposition thereto. In order to maintain the two respective materials together because of their differing plastic composition, it is necessary to bond the interior of the third zone 70 comprising the 100% ABS and the solvent to the ABS material of the wall 26. This is accomplished by solvent 80 flowing through openings 82 so that it bonds the third zone 70 to the ABS wall 26. This effectively allows for bonding of the nose cone 12 and the material therein in its tightly fixed relationship to the body 14. In effect, the holes 82 when drilled through the side walls of the nose cone 13 provide for a thickened solvent to penetrate from the matrix of the third zone 70. Thus, the exposed ABS in the nose cone is permanently bonded to the body which is also made of ABS.

In looking at the matrix, it can be seen that the steel shot is shown as shot 90 and the ABS pellets are shown as pellets 92 forming the first zone 66. The second zone 68 is formed of the ABS pellets 94 in conjunction with the HDPE pellets 96. Finally, the third zone 70 is shown with the ABS pellets 98 joined by the matrix of the solvent 80 flowing through the pellets to provide for the resilient rigid joindure at the tubular portion 30 of the body 14.

Figure 4:
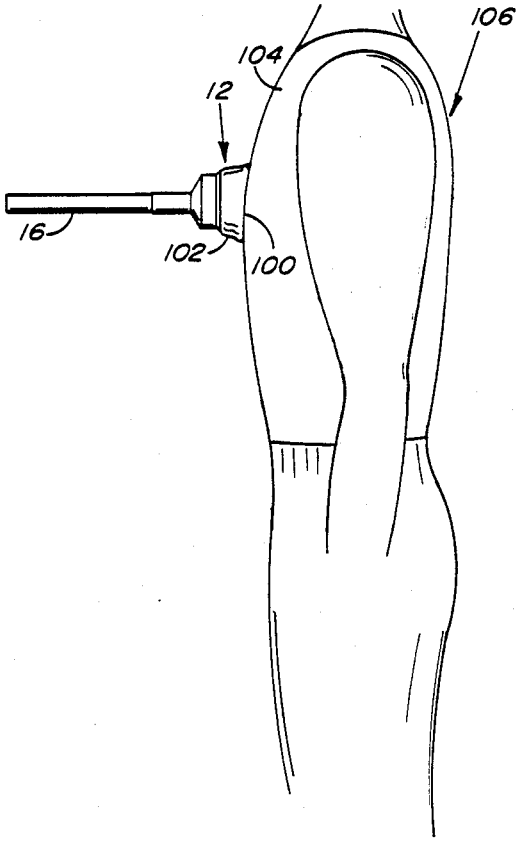
FIG. 4 shows a view of the projectile as it impacts a person's body or target.

When the projectile 10 is fired at a target as seen in FIG. 4, the launcher tube 16 is blown out of the barrel 52. The nose cone 12 upon impact is flattened or mushroomed out in a flattened area 100. Lines of deformation 102 are shown which allow the nose cone 12 to spread outwardly. This spreads the load of the impact across the target area 104 of a human subject 106. The target area 104 of the thorax thereby absorbs a lesser direct impact by being spread across the thorax of the target 106.

The weighted nose cone with the first zone 66 provides for aerodynamic flight characteristics with the weight in the nose leading the projectile. The rounded or ogival end 15 provides aerodynamic flight through the air. The flexible wall 18 allows for deformation as shown with the deformation of the cone as seen in the impact area 100.

The foregoing deformation is when impact of the zones 66 and 68 cause a friable or frangible deformation. The composite material in zones 66 and 68 breaks and thereby allows for a deformation and expansion. The crumbling frangible or friable impact of the materials in zones 66 and 68 creates a situation wherein the nose cone 12 substantially expands to create a situation wherein the impact of the nose cone is spread over the target area to a much greater extent.

The foregoing impact characteristics which spread the impact over a larger area creates a substantially lesser force of impact per square inch thereby limiting the damage to a target, than if the projectile 10 did not deform. This enhances the overall mushroom configuration upon impact so that the projectile spreads itself out and provides for improved load spreading and attendant safety to a greater degree than if a solid projectile were used.

The three respective zones 66, 68 and 70 can comprise alternative frangible or friable materials. These include ceramic materials, which fracture upon impact. It includes combinations and composites which perform the function of weighting as in zone 66 and the friable spreading upon impact as provided in zones 68 and 66.

The shotgun 50 can be a standard police issue shotgun. The projectile 10 is launched from the shotgun by means of a blank cartridge with a charge of powder. The charge of powder should be adequate to propel the projectile at 250 feet per second. This enables the projectile to impact the target at approximately 230 foot pounds of impact force.

Depending upon the forces and the relative values of the charge implaced in the shotgun, the impact required to fracture the friable matrix can vary. In order to do this, the ratio of the solvent weldable material and non-solvent weldable material can be changed. Thus, the impact required to fracture the friable matrix is governed by the ratio between solvent weldable and non-solent weldable materials. For instance, the greater the solvent weldable materials, the greater impact force required. The lesser the solvent weldable material with respect to the non-solvent weldable materials, the less impact is required.

The foregoing will be claimed hereinafter in claims which should be read broadly in light of the prior art and the inventive characteristics of this invention.

I claim:

1. A projectile for insertion into a shotgun muzzle extrinsic from its source of propulsion for shooting against a target such as an animal target which is designed to decrease damage to the target comprising:

a nose section having an outer wall of a material which is sufficiently deformable to allow deformation upon impact and sufficiently resilient to provide for maintenance of the characteristics of said nose section for aerodynamic flight;

a second section attached to said nose section which is attached to and trails behind said nose section upon firing formed as an elongated launching tube suitable for emplacement within a shotgun muzzle so that upon firing thereof it is discharged from the shotgun; and, a friable material within said nose section outer wall formed in part of bonded pelletized materials that breaks upon impact and allows the nose section to expand to provide a greater surface area upon impact to impart the projectile force over a greater surface area.

2. The projectile as claimed in claim 1 wherein:

said nose section outer wall is formed of a flexible plastic including the group consisting of polyurethane and polyvinylchloride flexible plastics.

3. The projectile as claimed in claim 1 further comprising:

protuberances extending beyond the outer dimensions of said launching tube for frictionally engaging the interior dimensions of a shotgun barrel.

4. The projectile as claimed in claim 1 wherein:

said nose section comprises a nose cone; and, said friable material comprises at least in part metallic portions mixed with a plastic portion which will break upon impact of a target.

5. The projectile as claimed in claim 4 wherein:

said friable material comprises a first zone formed of metal shot and plastic pellets which have been formed in a matrix; and, a second zone formed partially of plastic pellets bonded with a solvent to each other and having differing plastic pellets not bonded to each other.

6. The projectile as claimed in claim 5 further comprising:

a nose cone formed of a polyurethane flexible plastic walled material which deforms upon impact when the friable material has been broken therein to allow the spread of said nose cone over a target area.

7. The projectile as claimed in claim 6 further comprising:

a third zone that is a rigidified non-friable portion in said nose cone interconnecting said nose cone to said second zone and said launching tube for insertion in the muzzle of a shotgun barrell.

8. The projectile as claimed in claim 7 further comprising:

a body member extending between said nose cone and said launching tube.

9. A projectile for insertion into a shotgun muzzle extrinsic from its propulsion source for firing against a target such as a human being or animal or order to partially immobilize the target comprising:

a walled nose cone of an aerodynamic shape formed of a flexible plastic material which deforms upon impact into a mushroomed condition and retains the frangible material therein and having a weighted portion towards the leading portion of said nose cone;

an elongated launching tube connected to said nose cone for receipt within the muzzle of a shotgun; and, a frangible material formed at least in part of discretely bonded segments within the walls of said nose cone that breaks upon impact against the target and allows said nose cone to spread over the target area to a greater extent than prior to the frangible material breaking.

10. The projectile as claimed in claim 9 further comprising:

a first zone of frangible material incorporating materials comprised of greater and lesser densities; and, a second zone of frangible material formed of plastic segments which are held together by plastic bonding until impact and break upon impact.

11. The projectile as claimed in claim 10 further comprising:

a launching tube having at least one protuberance which frictionally engages the interior of a shotgun muzzle for holding it within the shotgun muzzle until firing.

12. The projectile as claimed in claim 11 wherein:

said first zone materials of said nose cone comprises shot mixed with a plastic material formed as a combination frangible material.

13. A projectile extrinsic from its source of propulsion for shooting from a shotgun against a target which is designed to limit the damage therefrom by spreading the force of said projectile over an increased area comprising:

a nose cone formed of a flexible plastic walled material capable of deformation upon impact;

a weighted section of said nose cone to allow for aerodynamic stability upon firing;

a frangible portion formed at least in part of metal shot and plastic segments in a bonded matrix to allow for frangible deformation thereof upon impact and spreading of the force over a broader area than the area of said nose cone prior to impact in said nose cone wall to allow for spreading of the force of said projectile over a larger area of said target; and, an elongated launching tube connected to said nose cone for receipt within the muzzle of a shotgun.

14. The projectile as claimed in claim 13 further comprising:

at least one protuberance on said launching tube for frictionally securing said projectile within a shotgun barrel prior to firing.

15. The projectile as claimed in claim 13 further comprising:

a body portion of ABS material joined between said nose cone and said launching tube.

16. The projectile as claimed in claim 14 further comprising:

a second frangible portion in said nose cone which does not have a weighted portion therein; and, a third portion within said nose cone which interconnects said nose cone to said launching tube.

17. The projectile as claimed in claim 16 wherein:

said second frangible portion is formed of a matrix of high density polyethylene plastic pellets and ABS plastic pellets which are held together by a solvent bonding one of said plastic pellets to each other and holding the second of said plastic pellets in a non-bonded condition to each other.

* * * * *